United States Patent [19]

Minenko et al.

[11] Patent Number: 4,549,760

[45] Date of Patent: Oct. 29, 1985

[54] DEVICE FOR GRIPPING AND HOISTING PACKED SACKS

[75] Inventors: Leonid P. Minenko; Evgeny V. Belikov; Oleg V. Bobryshev, all of Rostov-na-Donu; Lev M. Klyatis, Moscow; Ivan K. Mescheryakov, Rostov-na-Donu; Viktor G. Osipov, Moscow; Mikhail I. Osher, Rostov-na-Nonu; Nikolai P. Plyakin, Rostovskaya, all of U.S.S.R.

[73] Assignee: Tsentralnaya Experimentalno-issledovatelskaya Konstruktorsko-Tekhnologicheskaya Laboratoria Khimizatsii Selskogo Khozyaistva, Moskovskaya, U.S.S.R.

[21] Appl. No.: 587,538

[22] Filed: Mar. 8, 1984

[30] Foreign Application Priority Data

Jun. 6, 1983 [SU] U.S.S.R. ..... 3595899

[51] Int. Cl.[4] ..... B66C 1/42; B66C 1/10

[52] U.S. Cl. ..... 294/88; 294/103.1

[58] Field of Search ..... 294/88, 1 R, 74, 83 R, 294/86 R, 103 R, 104; 24/68 R, 68 A, 71.2, 136 R, 197, 269; 242/74 R; 414/607, 608, 618, 619, 620, 621, 622

[56] References Cited

U.S. PATENT DOCUMENTS 4,181,345 1/1980 Achelpohl ..... 294/88

4,226,458 10/1980 Achelpohl et al. ..... 294/88

FOREIGN PATENT DOCUMENTS 2646493 4/1978 Fed. Rep. of Germany .

*Primary Examiner*—James B. Marbert

*Attorney, Agent, or Firm*—Fleit, Jacobson, Cohn & Price

[57] ABSTRACT

A device for gripping and hoisting packed sacks includes a contrivance for mounting the device onto a hoisting machine, load bearing members rigidly coupled to the contrivance for mounting the device onto a hoisting machine. The load bearing members carry vertical plates hinged thereto and turnable from an actuator. The free ends of the load bearing members has slots whose longer faces are in a position of angularity with respect to the end faces of the load bearing members. The device incorporates also two rods arranged parallel to each other, of which the rod is rigidly fixed with its ends to the vertical plates while the other rod is fitted in the slots of the load bearing members. The load bearing member carries a mechanism for restricting the load upon the actuator imparting turning motion to the vertical plates, said mechanism being kinematically associated with the rod fitted in the slots of the slots of the load bearing members.

20 Claims, 4 Drawing Figures

DEVICE FOR GRIPPING AND HOISTING PACKED SACKS

The present invention relates generally to hoisting devices and more specifically, to devices for gripping and hoisting packed (filled) sacks or bags.

TECHNICAL FIELD

The alleged invention will find application in chemical, farming, construction and some other industries engaged in handling, conveying and storing of sacked or bagged materials.

BACKGROUND OF THE INVENTION

The problem of handling and short-distance conveying of predominately sacked cargoes one is faced with in farming industry is concerned with the fact that no handling means having adequate load hoisting height are available for loading transportation facilities and machines with inorganic fertilizer under field conditions. Principally, the problem consists in loading large-capacity sacks onto and unloading them from transportation facilities, as well as in charging fertilizer applicator machines using loaders with an adequate capacity available in farming industry.

Most widely known in the art is a device for gripping and hoisting filled sacks, containing a contrivance for mounting it onto a hoisting machine, and load bearing members rigidly coupled to the contrivance for mounting it onto a hoisting machine. The load bearing members carry vertical plates hinged thereto. The device under consideration incorporates also two rods arranged parallel to each other, one of which is rigidly fixed to the vertical plates at its ends, while the other rod is articulated at its ends to said vertical plates. An actuator is provided for the vertical plates to turn, said actuator being in fact at least one control arm. The contrivance for mounting the device onto a hoisting machine is essentially a clevis coupled to the load bearing members. The device in question is mounted, through the clevis, onto the load hook of the hoisting machine boom. With the help of the boom the device for gripping and handling filled sacks is brought to the throat of a filled sack. Next the sack is passed into the gap between the two rods the sack throat having been preliminarily put onto the rod rigidly fixed in the vertical plates. Then the control arm linked to the vertical plates is turned to grip the throat of the filled sack in the device, and the filled sack is hoisted and transferred to a required place. This done the sack throat is released from the device by turning the control arm in the direction opposite to that of gripping.

However, the aforementioned construction of the device for gripping and handling filled sacks makes it impossible to extend the boom reach of a hoisting machine, thus rendering impossible the loading of large-capacity sacks into the existing transportation facilities unless trestle-work is used. Inasmuch as the actuator for the vertical plates to turn is made as a manually operated control arm, an additional attendant is required for releasing the sack after its having been put onto a desired place.

Application of the aforementioned device is fraught with a danger to inflict injury upon the operator at the instant he releases the sack throat. Such a danger is due to a possibility of a premature raising of the hoisting device boom at the instant when the control arm is turned to release the sack throat.

BRIEF DESCRIPTION OF THE INVENTION

It is therefore a primary and essential object of the present invention to provide a device for gripping and hoisting filled sacks the construction arrangement of which would make it possible to attain an increased hoisting height of sacks that will suffice for loading the now-existing transportation facilities, to improve labour conditions and reduce the number of attending people.

The aforesaid object is accomplished due to the fact that in a device for gripping and hoisting filled sacks, comprising a contrivance for mounting said device onto a hoisting machine, load bearing members rigidly locked with the contrivance for mounting the device onto a hoisting machine, vertical plates hinged to the load bearing members, two rods arranged parallel to each other, one of said rods being rigidly fixed with its ends to said vertical plates, and an actuator for the vertical plates to turn, according to the invention, the vacant ends of the load bearing members have slots whose longer faces are in a position of angularity with the end faces of the load bearing members, said slots being adapted to receive the other of the aforesaid rods, and provision is made for a mechanism for restricting the turn of the vertical plates, said mechanism being situated on the load bearing member and kinematically linked to the rod fitted in the slots of the load bearing members.

It is expedient that with a view to attaining better operational reliability of the device and further improvement in labour conditions the vertical plates be so bent that the rod fitted in the slots of the load bearing members would be situated on the concave side of the vertical plates whatever the position they assume.

It is also expedient that with a view to simplifying the construction of the device the mechanism for load restriction upon the actuator for the vertical plates to turn be made as double-armed levers, one of the ends of said double-armed levers carrying a hook adapted to engage the rod secured on the vertical plates when the sack is being hoisted, while the other end of the double-armed levers is kinematically associated with the rod fitted in the slots of the load bearing members.

It is quite apparent that with a view to reducing specific metal content the rod fitted in the slots of the load bearing members be made hollow and filled with a kind of ballast whose mass is equal to that of an empty sack.

It is also reasonable that with a view to further bettering of labour conditions the actuator for the vertical plates to turn be made as a power cylinder whose barrel is mounted on the load bearing member and the piston rod is kinematically associated with the apical point of the curved vertical plate.

Practical application of the invention will enable one to improve labour conditions of attending personnel, cut down the number of attendants and will make it possible to operate in conjunction with the existed transportation facilities.

BRIEF DESCRIPTION OF THE DRAWINGS

The aforementioned advantages of the invention will become more apparent from a detailed description of a device for gripping and hoisting packed sacks, consideration of specific exemplary embodiments thereof and the accompanying drawings. In the drawings.

DETAILED DESCRIPTION OF THE INVENTION

Figure 1:
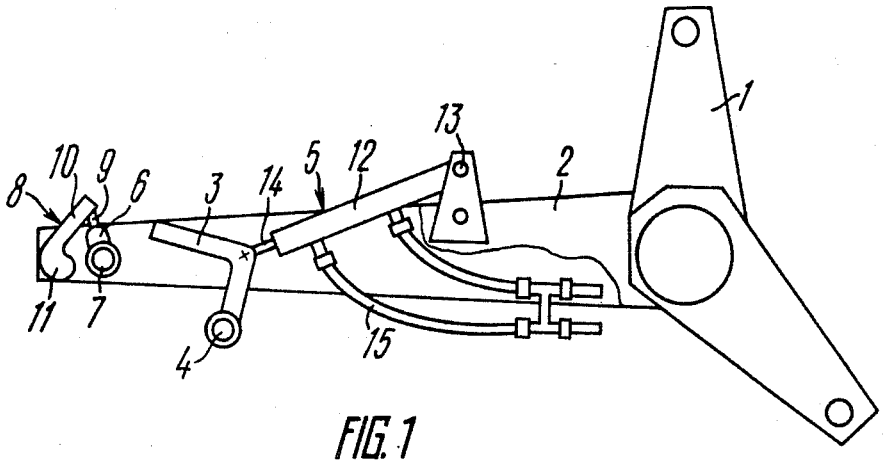
FIG. 1 is a general side-elevation, partly cut away view of a device for gripping and hoisting packed sacks, according to the invention.

The device for gripping and hoisting filled sacks comprises a contrivance 1 (FIG. 1) for mounting the device onto a hoisting machine (not shown), load bearing members 2 ridigly coupled to the contrivance 1 for mounting the device onto a hoisting machine. Vertical plates 3 are hinged on the load bearing members 2. A rod 4 is fixed rigidly with its ends to the vertical plates 3. An actuator 5 is provided for the vertical plates 3 to turn. The free ends of the load bearing members 2 have slots 6, which are in an angular position with respect to the end faces of the load bearing members 2.

Another rod 7 is fitted in the slots 6 of the load bearing members 2, said rod being parallel to the rod 4.

The device for gripping and hoisting filled sacks incorporates also a mechanism 8 for restriction of load upon the actuator for the vertical plates to turn, said mechanism being mounted on the load bearing member 2 and kinematically associated with the rod fitted in the slots 6 of the load bearing members 2, via links 9.

The vertical plates 3 are so curved that the rod 7 fitted in the slots 6 of the load bearing members 2 is situated on the concave side of the vertical plates 3 whatever the position these plates assume. It is also possible that the vertical plates 3 are straight members.

Figure 2:
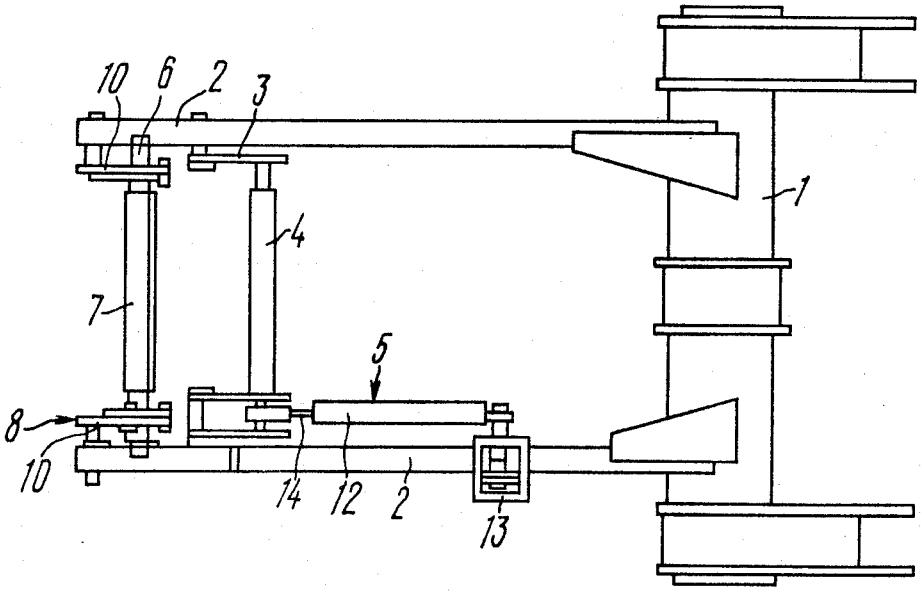
FIG. 2 is a general top view of a device, according to the invention.

The mechanism 8 for restriction of load upon the actuator for the vertical plates to turn is made as double-armed levers 10 (FIG. 2), one of the ends of said double-armed levers carrying a hook 11 adapted to engage the rod 4 fixed in the vertical plates 3 when the sack is being hoisted, while the other ends of the double-armed levers 10 are kinematically associated with the rod 7 fitted in the slots 6 of the load bearing members 2.

Another embodiment of said mechanism is also practicable, wherein the rod 7 fitted in the slots 6 of the load bearing members 2 is made hollow and filled with a kind of ballast whose mass equals that of an empty sack.

The actuator 5 for the vertical plates to turn is in fact a hydraulic power cylinder whose barrel 12 is mounted on the load bearing member 2 through a hinge 13 (FIGS. 2, 3) and a piston rod 14 is kinematically associated with the apical point of the curved vertical plate 3. The barrel 12 of the actuator 5 communicates with the hydraulic system (not shown) through pipings 15.

The device for gripping and hoisting filled sacks operates as follows.

The device of the invention is mounted, through the contrivance 1 (FIG. 1), onto the frame of the lifting gear of a hoisting machine (not shown) and is connected to its truss (not shown).

The vertical plates 3 of the device are put above a sack 16 (FIG. 3) by virtue of the lifting gear of a hoisting machine (not shown). Then the vertical plates 3 are brought to the rearmost position by the actuator 5 (FIG. 1).

Figure 3:
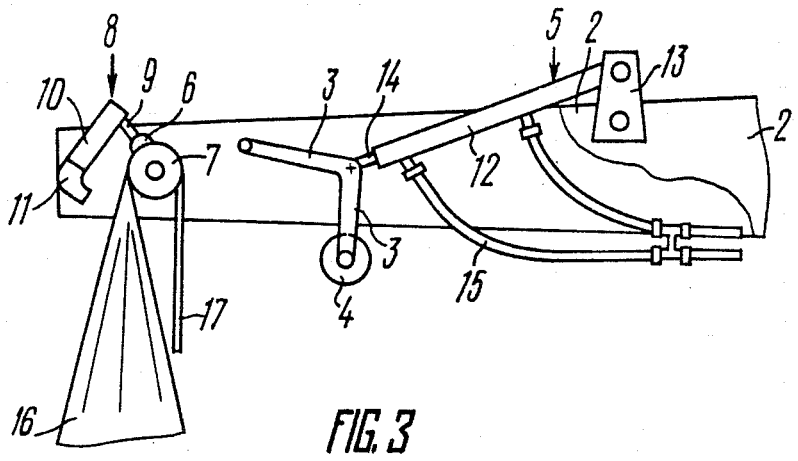
FIG. 3 is a side-elevation, partly cut away view of the load bearing members of a device for gripping and hoisting packed sacks showing the throat of a sack put onto the rod of the device according to the invention.
Figure 4:
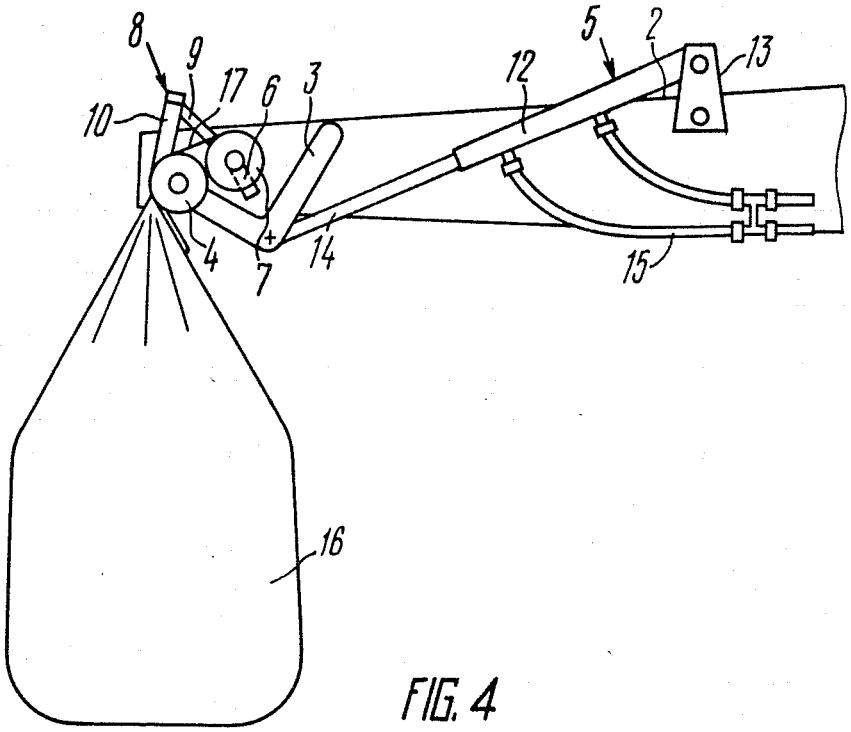
FIG. 4 is a side-elevation, partly cut away view of the load bearing members of a device for gripping and hoisting packed sacks shown at the instant when the throat of a sack is forced against the rod of the device, according to the invention.

It is due to the fact that the slots 6 are provided at the free ends of the load bearing members 2 that the rods 4 and 7 (FIG. 2) are spaced very widely apart with the rod 4 in the rearmost position. This makes it simple and easy to bring the throat 17 of the sack 16 put onto the rod 7 beforehand, into the gap left between the rod 4 and 7 (FIG. 3). Thus, the time required for the above operation is cut down and hence the through put capacity of the device is increased. Once the throat 17 of the sack 16 has been passed into the gap between the rods 4 and 7, the rod 4 is brought together with the rod 7 by virtue of the actuator 5 for the vertical plates to turn so as to force the throat 17 (FIG. 4) of the sack 16 against the rod 7. At the same time the rod 7 moves upwards along the slots 6. As the sack 16 is being lifted with the help of the device, the throat 17 of the sack 16 gets finally gripped under the own mass of the sack.

The throat 17 of the sack 16 is released either automatically without assistance of the operator when the sack 16 is put onto a supporting surface, or after the sack has been emptied, due to the mass of the gripping rod 7 which, while moving down along the slots 6, releases the throat 17 of the sack 16.

As a result, the throat 17 of the sack 16 is free to fall down from the rod 7 when the rod 4 is brought to the rearmost position.

The provision of the vertical plates 3 as curved bars makes it possible to simplify additionally the passing of the throat 17 of the sack 16 into the gap between the rods 4 and 7, since with such an embodiment of the vertical plates 3 the rods 4 and 7 are spaced still more widely apart.

As the throat 17 of the sack 16 is being pressed, the rod 7, while traveling in the slots 6, turns, through the links 9, the double-armed levers 10 of the mechanism 8 for restricting the load upon the actuator for the vertical plates to turn. As a result, the hooks 11 of the double-armed levers 10 engage the rod 4, and the whole mass of the lifted sack 16 is taken up by the hooks 11, whereby the vertical plates 3 can be relieved from the mass of the sack 16 and occasional releasing of the throat 17 of the sack 16 may be avoided.

In order that the throats 17 of the sacks 16 of different sizes and hence different masses may be reliably released in the device of the invention, the mass of the rod 7 is adjusted to suit the mass of the empty sack 16 to be handled in every particular case.

To improve labour conditions and cut down the number of workers attending to the device, the vertical plates 3 are made to move by admitting the power fluid from the hydraulic system of the hoisting machine (not shown) to flow along the pipings 15 into the barrel 12 of the hydraulic power cylinder of the actuator 5 for the vertical plates to turn. As a result, the piston rod 14 kinematically associated with the apical point of the curved vertical plate 3 causes the vertical plates to move to either side.

Practical application of the invention will make it possible to cut down time required for handling operations and load transportation facilities without resorting to any additional appliances or devices.

I claim:

1. A device for gripping and hoisting packed sacks, said device comprising:

a contrivance for mounting said device onto a hoisting machine;

load bearing members each having two ends, one of said two ends for each of said load bearing members being rigidly coupled to the contrivance for mounting said device onto said hoisting machine, slots defined in the other free ends of the load bearing members, the longer faces of said slots are in a position of angularity with end faces of said load bearing members;

vertical plates hinged on said load bearing members;

a first rod rigidly fixed by its ends in said vertical plates;

a second rod mounted parallel to said first rod in said slots of said load bearing members;

an actuator for imparting a turning motion to said vertical plates; and a mechanism for restricting the load upon said actuator that imparts turning motion to the vertical plates, said mechanism being mounted on said load bearing member and being kinematically associated with said second rod.

2. A device as claimed in claim 1, wherein said vertical plates are shaped as curved bars so that said second rod is situated on a concave side of the vertical plates whatever the position said plates assume.

3. A device as claimed in claim 1, wherein said mechanism for restricting the load upon the actuator for the vertical plates includes double-armed levers; the first end of said levers carrying a hook adapted to engage the first rod upon hoisting a sack; the second end of said double-armed levers is kinematically associated with said second rod.

4. A device as claimed in claim 2, wherein said mechanism for restricting the load upon the actuator for the vertical plates includes double-armed levers; the first end of said double armed levers carrying a hook adapted to engage the first rod upon hoisting a sack; the second end of said double-armed levers is kinematically associated with said second rod.

5. A device as claimed in claim 2, comprising said second rod which is made hollow and filled with ballast whose mass is equal to that of an empty sack.

6. A device as claimed in claim 3, comprising said second rod which is made hollow and filled with ballast whose mass is equal to that of an empty sack.

7. A device as claimed in claim 2, wherein said actuator for the vertical plates includes a power cylinder; a barrel of said power cylinder is mounted on one of said load bearing members; a piston rod of said power cylinder is kinematically associated with the apical point of the curved bar of the vertical plate.

8. A device as claimed in claim 4, wherein said actuator for the vertical plates includes a power cylinder; a barrel of said power cylinder is mounted on one of said load bearing members; a piston rod of said power cylinder is kinematically associated with the apical point of the curved bar of the vertical plate.

9. A device as claimed in claim 5, wherein said actuator for the vertical plates includes a power cylinder; a barrel of said power cylinder is mounted on one of said load bearing members, a piston rod of said power cylinder is kinematically associated with the apical point of the curved bar of the vertical plate.

10. A device for gripping and hoisting packed sacks, said device comprising:

a contrivance for mounting said device onto a hoisting machine;

load bearing members each having two ends, one of said two ends of each load bearing member being rigidly coupled to the contrivance for mounting said device onto said hoisting machine;

slots defined in the other free ends of the load bearing members, the longer faces of said slots are in a position of angularity with end faces of said load bearing members;

vertical plates hinged on said load bearing members;

a first rod rigidly fixed by its ends in said vertical plates;

a second rod mounted parallel to said first rod in said slots of said load bearing members, said second rod being hollow and being filled with ballast whose mass is equal to that of an empty sack;

an actuator for imparting a turning motion to said vertical plates; and a mechanism for restricting the load upon said actuator that imparts turning motion to the vertical plates, said mechanism being mounted on said load bearing member and being kinematically associated with said second rod.

11. A device as claimed in claim 10, wherein said vertical plates are shaped as curved bars so that said second rod is situated on a concave side of the vertical plates whatever the position said plates assume.

12. A device as claimed in claim 10, wherein said mechanism for restricting the load upon the actuator for the vertical plates includes double-armed levers; the first end of said levers carrying a hook adapted to engage the first rod upon hoisting said sack; the second end of said double-armed levers is kinematically associated with said second rod.

13. A device as claimed in claim 11, wherein said mechanism for restricting the load upon the actuator for the vertical plates includes double-armed levers; the first end of said double-armed levers carrying a hook adapted to engage the first rod upon hoisting a sack; the second end of said double-armed levers is kinematically associated with said second rod.

14. A device as claimed in claim 11, wherein said actuator for the vertical plates includes a power cylinder; a barrel of said power cylinder is mounted on one of said load bearing members; a piston rod of said power cylinder is kinematically associated with the apical point of the curved bar of the vertical plate.

15. A device as claimed in claim 13, wherein said actuator for the vertical plates includes a power cylinder; a barrel of said power cylinder is mounted on said load bearing members; a piston rod of said power cylinder is kinematically associated with the apical point of the curved bar of the vertical plate.

16. A device for gripping and hoisting packed sacks, said device comprising:

mounting means for mounting said device onto a hoisting machine;

load bearing members each having two ends and each load bearing member being rigidly coupled to said mounting means at one of said two ends;

slots defined at the free ends of said load bearing members, said slots extending in a direction at an angle to end faces of said load bearing members;

vertical plates hinged on said load bearing members;

a first rod rigidly fixed by its ends to said vertical plates;

a second rod mounted in said slots parallel to said first rod;

actuating means for moving said vertical plates to turn said first rod; and load means for restricting the load upon said actuating means, said load means being mounted on said load bearing members and being kinematically associated with said second rod so that when said actuator means moves said first rod to displace said second rod and a sack, load means relieves pressure exerted on said actuator means by said first rod having displaced said second rod and said sack.

17. A device as claimed in claim 16, wherein said vertical plates are shaped as curved bars so that said second rod is situated on a concave side of the vertical plates whatever the position said plates assume.

18. A device as claimed in claim 16, wherein said load means includes double-armed levers; a first end of said double-armed levers carrying a hook adapted to engage the first rod upon hoisting said sack; a second end of said double-armed levers is kinematically associated with said second rod.

19. A device as claimed in claim 16, wherein said second rod is hollow and is filled with ballast whose mass is equal to that of an empty sack.

20. A device as claimed in claim 16, wherein said actuating means includes a power cylinder; a barrel of said power cylinder is mounted on one of said load bearing members; a piston rod of said power cylinder is kinematically associated with the apical point of the curved bar of the vertical plate.

* * * * *